US006677714B2

(12) United States Patent
Du et al.

(10) Patent No.: US 6,677,714 B2
(45) Date of Patent: Jan. 13, 2004

(54) METHOD FOR DRIVING AN ALTERNATING CURRENT PLASMA DISPLAY PANEL AND CIRCUIT THEREFOR

(75) Inventors: Ji-Bin Du, Taipei (TW); Yu-Ting Chien, Taipei (TW); Shin-Tai Lo, Taipei (TW)

(73) Assignee: AU Optronics Corp., Hsinchu (TW)

( * ) Notice: Subject to any disclaimer, the term of this patent is extended or adjusted under 35 U.S.C. 154(b) by 0 days.

(21) Appl. No.: 10/268,989

(22) Filed: Oct. 11, 2002

(65) Prior Publication Data

US 2003/0071577 A1 Apr. 17, 2003

(30) Foreign Application Priority Data

Oct. 12, 2001 (TW) ..... 90125326 A
Mar. 15, 2002 (TW) ..... 91105013 A

(51) Int. Cl.[7] ..... G09G 5/00
(52) U.S. Cl. ..... 315/169.4; 345/204
(58) Field of Search ..... 315/169.4, 169.3, 315/169.1; 345/204

(56) References Cited

U.S. PATENT DOCUMENTS 6,198,476 B1 * 3/2001 Hong et al. ..... 345/204

* cited by examiner

*Primary Examiner*—David Hung Vu
(74) *Attorney, Agent, or Firm*—Birch, Stewart, Kolasch & Birch, LLP

(57) ABSTRACT

A method for driving an alternating current plasma display panel (AC PDP) during a reset period is disclosed. Firstly, a first erase pulse, being positive in polarity and increasing in magnitude with time, is applied to a first electrode so as to remove wall charges from the pixel units. Then, a first priming pulse of negative polarity and a second priming pulse of positive polarity increases in magnitude with time and are respectively applied to the first electrode and a second electrode so as to produce the wall charges in the pixel units. Finally, a second erase pulse, being positive in polarity and increasing in magnitude with time, is applied to the first electrode so as to remove the redundant wall charges.

17 Claims, 7 Drawing Sheets

METHOD FOR DRIVING AN ALTERNATING CURRENT PLASMA DISPLAY PANEL AND CIRCUIT THEREFOR

This nonprovisional application claims priority under 35 U.S.C. §119(a) on Patent Application No. 090125326 filed in TAIWAN on Oct. 12, 2001, which is herein incorporated by reference.

BACKGROUND OF THE INVENTION

1. Field of the Invention

The invention relates in general to a method for driving a plasma display panel (PDP) and circuit therefor, and in particular, to a method for driving an alternating current plasma display panel (AC PDP) during the reset period and circuit therefor.

2. Description of the Related Art

As the fabrication technology of the audio/video (A/V) devices is developing rapidly, higher quality audio and video services are foreseen popular among the users. Take the display device for example. The conventional cathode ray tube (CRT) display cannot provide better audio and video quality than movies, as well as having the disadvantages of large volume, serious radiation issue, and serious image contortion and distortion at the brim region of the screen. The conventional CRT display device certainly cannot satisfy the demands for higher quality audio and video services. Thus, the high definition digital television (HDTV) system has been developing to meet these demands for higher audio and video quality comparable to that of a movie. When the HDTV begins to broadcast and the compliant products become more affordable, the CRT displays will be phased out. In addition, the plasma display panel (PDP) display, with the advantages of low radiation, low power consumption, and large display area with small volume, is a very-promising HDTV display to replace the CRT display.

FIG. 1 shows a cross-sectional view of one pixel unit 100 of a tri-electrode alternating current plasma display panel (AC PDP). The ACPDP includes a front glass plate 102, a dielectric layer 104, a protective layer 106, a rear glass plate 108, a fluorescence layer 110, and a dielectric layer 116. Each pixel unit includes a sustain electrode X, a scan electrode Y, and a data electrode A. The front glass plate 102 has a plurality of sustain electrodes X and scan electrodes Y which are arranged alternately and in parallel on the front glass plate 102. The dielectric layer 104, covering the sustain electrodes X and scan electrodes Y, is used for accumulating wall charges, and is covered by the protective layer 106 formed by magnesium oxide (MgO). The protective layer 106 is used for protecting the X electrodes, the Y electrodes, and the dielectric layer 104. The data electrode A is formed on the back glass plate 108 opposite to the front glass plate 102, and is orthogonal to the X electrode and the Y electrode respectively. The data electrode A is covered by the dielectric layer 116. The fluorescence layer 110 is formed on the dielectric layer 116 and the sidewalls of the spacer. The space between the protective layer 106 and the fluorescence layer 110 is called a discharge space 114 and is filled with the discharge gas mixed with Ne and Xe.

The PDP includes a plurality of pixel units 100, disposed in the form of a rectangle matrix. It further includes a driving circuit for driving these pixel units 100 according to a regular driving sequence. Each pixel unit 100 can be regarded as a capacitive load and the driving circuit provides the alternating current of high frequency for charging each pixel unit 100 through the corresponding sustain electrode X and scan electrode Y The gas in the discharge space 114 are excited, discharged, and then emit UV light. The fluorescence layer 110 absorbs the UV light of specified wavelengths and then emits visible lights.

FIG. 2 illustrates the timing chart of a conventional driving circuit. The driving sequence includes a reset period T1, an address period T2, and a sustain period T3 respectively. In the reset period T1, each pixel unit is reset by respectively applying erase pulses to the corresponding sustain electrode X and the scan electrode Y so that the accumulation of the wall charges for each pixel unit is set to the same. In the address period T2, the image data signals are applied to the pixel units selected to emit lights. In the sustain period T3, light pulses are produced by applying alternating voltages across the sustain electrode X and the scan electrode Y of the selected pixel units by the help of the memory effect of the wall charges.

As shown in FIG. 2, the reset period T1 includes three periods: a first reset period T11, a second reset period T12, and a third reset period T13. During the first reset period T11, a first erase pulse $P_{Y1}$ of about 100 $\mu$s duration is applied to all the scan electrodes Y to remove the wall charges remaining after the last sustain period. During the second reset period T12, a priming pulse $P_{X2}$, being a square pulse of high level voltage and positive polarity, is applied to all the sustain electrodes X to produce wall charges of the pixel units again. Since the use of the priming pulse $P_{X2}$ results in an instant high voltage across the sustain electrode X and scan electrodes Y, the discharge gas in the discharging space 114 is excited, producing the wall charges in each pixel unit. During the third reset period T13, a second erase pulse $P_{Y3}$ of about 100 $\mu$s duration is applied to the all scan electrodes Y to remove the redundant wall charges in each pixel unit.

However, the manufacturing cost is high because a complex circuit is needed to provide an instant high voltage during the second reset period T12. Besides, the fierce discharging in the second reset period T12 will lower the brightness contrast of the PDP owing to the increasing in background brightness Therefore, it is desirable to provide a low cost and high brightness-contrast PDP.

SUMMARY OF THE INVENTION

It is therefore an object of the invention to provide a method of driving an AC PDP during a reset period to cause the distribution of the wall charges in the pixel units to be less different. Improved brightness contrast of the ACPDP is achieved since the background brightness is reduced during the reset period. In addition, a simplified driving circuit can be used to drive the ACPDP, thus resulting in reduced manufacturing cost.

The AC PDP has a plurality of pixel units, and each pixel units has a first electrode, a second electrode and a third electrode. The first electrode and the second electrode are parallel to each other, and the third electrode is perpendicular to the first electrode. Firstly, a first erase pulse is applied to the first electrode so as to remove the wall charges from the pixel units, wherein the first erase pulse is positive in polarity and increases slowly with time. Then, a first priming pulse and a second priming pulse are respectively applied to the first electrode and the second electrode so as to produce the wall charges on the plurality of pixel units, wherein the first priming pulse is negative in polarity and slowly increases in magnitude with time, and the second priming pulse is positive in polarity and slowly increases in magnitude with time. Finally, a second erase pulse is applied to the first electrode so as to remove the redundant wall charges, wherein the second erase pulse is positive in polarity and slowly increases in magnitude with time.

BRIEF DESCRIPTION OF THE DRAWINGS

Other objects, features, and advantages of the invention will become apparent from the following detailed description of the preferred but non-limiting embodiments. The description is made with reference to the accompanying drawings in which.

DESCRIPTION OF THE PREFERRED EMBODIMENT

Figure 1:
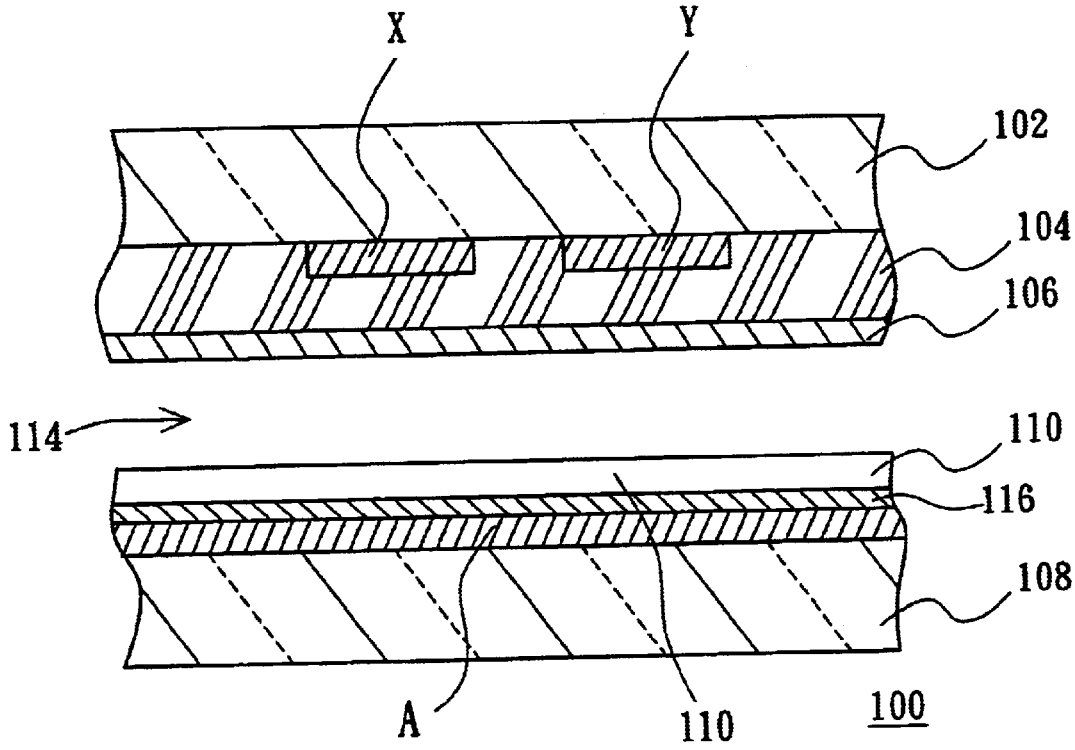
FIG. 1 (PRIOR ART)
FIG. 1 (Prior Art) illustrates a cross-sectional view of one pixel unit of a tri-electrode alternating current plasma display panel (ACPDP).
Figure 2:
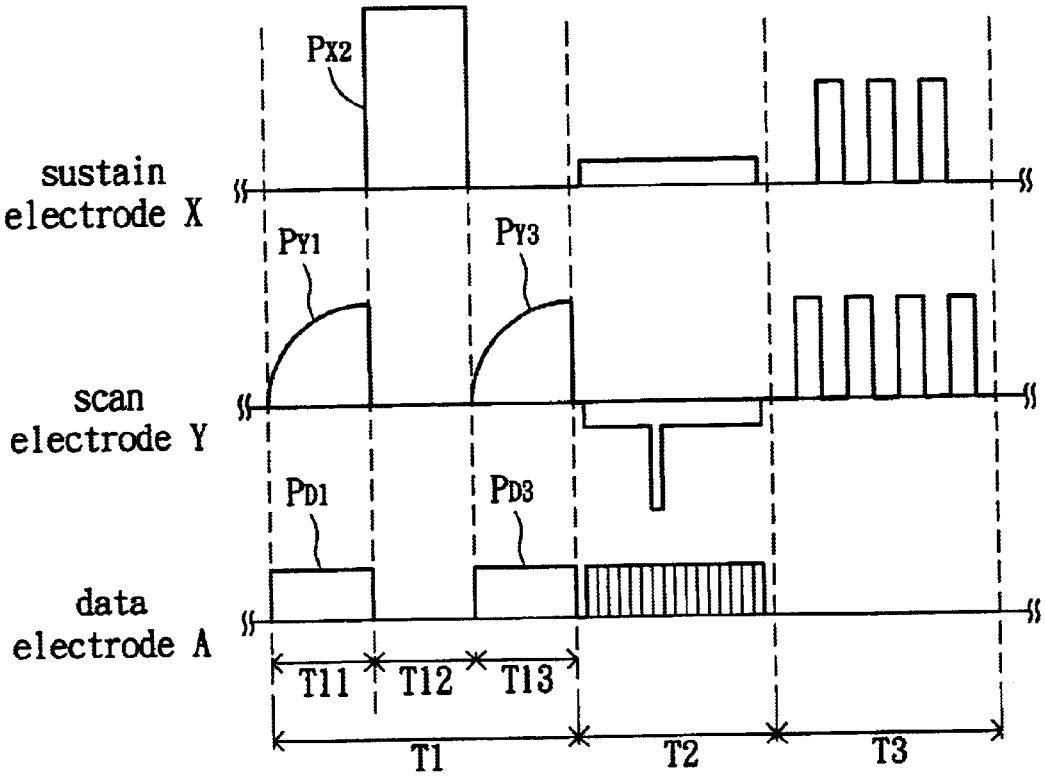
FIG. 2 (PRIOR ART)
FIG. 2 (Prior Art) illustrates the timing chart of a conventional driving circuit.
Figure 3:
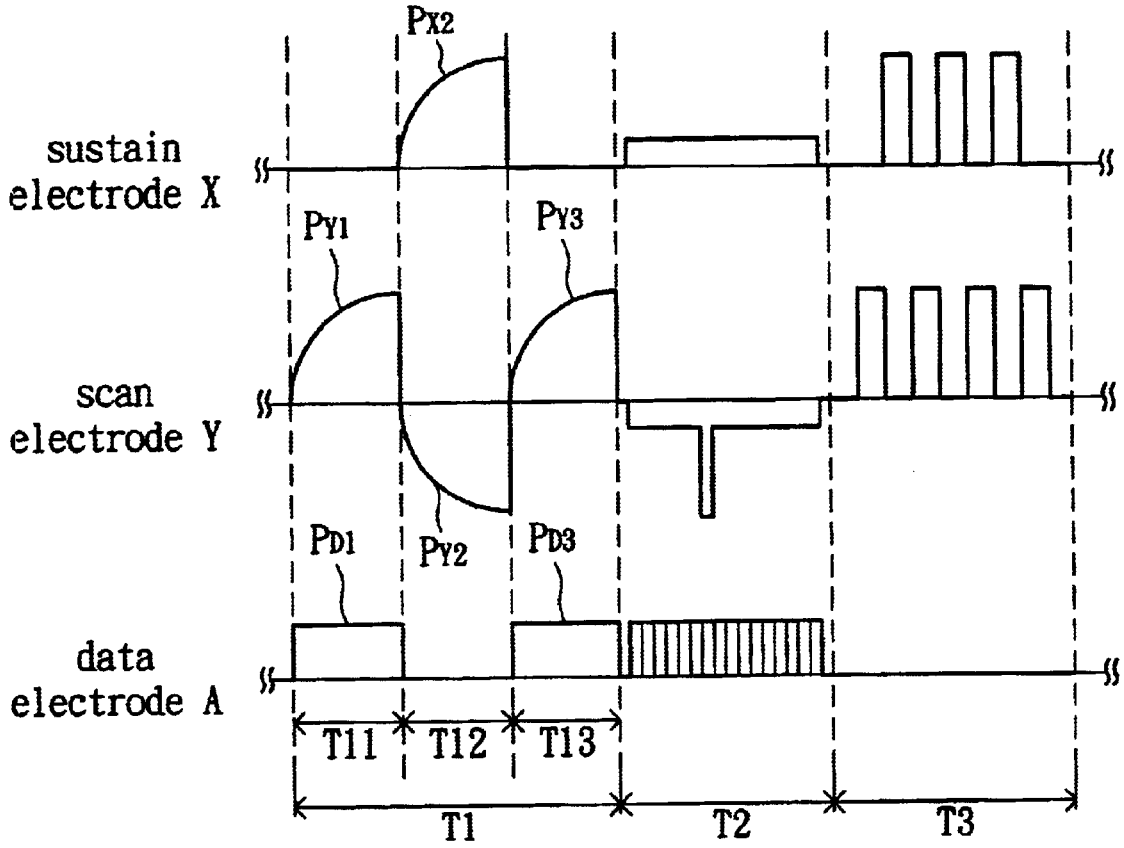
FIG. 3 is a timing chart illustrating a method for driving an ACPDP according a first embodiment of the invention.

A method of driving an ACPDP is illustrated in FIG. 3 in timing chart form. Unlike the conventional one illustrated in FIG. 2, the driving method of the invention applies two opposite-polarity voltages increasing in magnitude with time to the sustain electrode X and the scan electrode Y respectively during the second reset period T12.

In the beginning of the first reset period T11, because the pixel units are operated digitally, they are divided into two types according to their previous states. The first-type pixel units, which were enabled to emit light before the current reset period, e.g. acting as the bright spots in the previous image, have a large quantity of wall charges remaining. The second-type pixel units, being switched off in the previous image, have little or no wall charges thereon. Even so, the pixel units of the same type still have accumulation variation of the wall charges owing to the different data thereon.

During the first reset period T11, a first erase pulse $P_{Y1}$ is applied to the scan electrode Y in order to make the accumulation of the wall charges for all pixel units be the same. The first erase pulse $P_{Y1}$ is positive in polarity and increases slowly with time. In this case, the first-type pixel units discharge weakly to reduce the quantity of the wall charges thereon to a certain level, while the second-type pixel units does not discharge. Meanwhile, a first address pulse $P_{D1}$ is applied to the dielectric layer of the data electrode A to avoid too much charges remaining on the surface of the dielectric layer, wherein the first address pulse $P_{D1}$ is square shape in positive polarity.

During the second reset period T12, a first priming pulse $P_{Y2}$ and a second priming pulse $P_{X2}$ are respectively applied to the scan electrode Y and the sustain electrode X so as to re-excite the ionic gases and to re-produce the wall charges on the pixel units, wherein the first priming pulse $P_{Y2}$ and the second priming pulse $P_{Y2}$ are respectively negative and positive in polarity, and slowly increases in magnitude with time. Please note that the excitement of ionic gases is induced by a total voltage, which is the voltage across the sustain electrode X and the scan electrode Y by concerning the equivalent voltage produced by the wall charges.

In this case, as the total voltage, is just larger than the firing voltage of the ionic gases, the wall charges survived during the first reset period T11 will discharge weakly, not intensely, for the first time. Then, some charges accumulated in the dielectric layer decreases the magnitude of the total voltages, while the voltage across the sustain electrode X and the scan electrode Y continues to increase with time. As the total voltage is larger than the firing voltage again, the ionic gases discharges for the second time. Therefore, each pixel unit will discharge in approximately the same intensity for several times in the second reset period T12.

Because each display has different quantity of wall charges, and it will discharge at different timing. The larger quantity of the wall charges survive, the earlier of the discharging. Not like the discharging of different intensity in the first reset period T11, the discharging of almost the same intensity happens among all the pixel units during the second reset period T12. After a plurality of discharging processes occur in the second reset period T12, all pixel units differ much slightly in the accumulations of wall charges.

Compared with the traditional method, all pixel units of the present invention discharge weakly for several times at different timing instead all pixel units discharge intensely at the same time for once. Thus, the brightness contrast of the PDP increases due to the decreasing of the background brightness. In addition, a zero-level voltage applied to the data electrode A is within the intermediate area between the positive second-priming pulse $P_{Y2}$ and the negative first-priming pulse $P_{Y2}$. Thus, the discharge in vertical direction can be avoided, as well as the accumulation of the charges on the dielectric layer of the data electrode A.

At the end of the second reset period T12, zero-level voltages are applied to the sustain electrode X and the scan electrode Y, and all pixel units discharge at the same time so that the wall charges reduce to a certain level.

During the third reset period T13, a second erase pulse $P_{Y3}$ is applied to the scan electrodes Y of all pixel units in order to remove excess wall charges by weakly inducing the gases discharging. The second erase pulse $P_{Y3}$ is positive in polarity and slowly increases in magnitude with time. The difference of the wall-charge accumulation for all pixel units is further lowered. Besides, a second address pulse $P_{D3}$ is applied to the data electrode A so as to avoid the discharge in vertical direction, wherein the second address pulse $P_{D3}$ is a square shape in positive polarity.

Please note that the erase pulses and the priming pulses with the slowly increasing or decreasing waveforms can be produced, for example, by a one-order charge-discharge circuit. The one-order charge-discharge circuit can be implemented by combining an external resistance and an equivalent capacitance, wherein the pixel unit can act as the equivalent capacitance. Therefore, the structure of the one-order charge-discharge circuit is much simpler than that of the traditional method and the cost of the present invention is much less than that of the traditional method.

Figure 4:
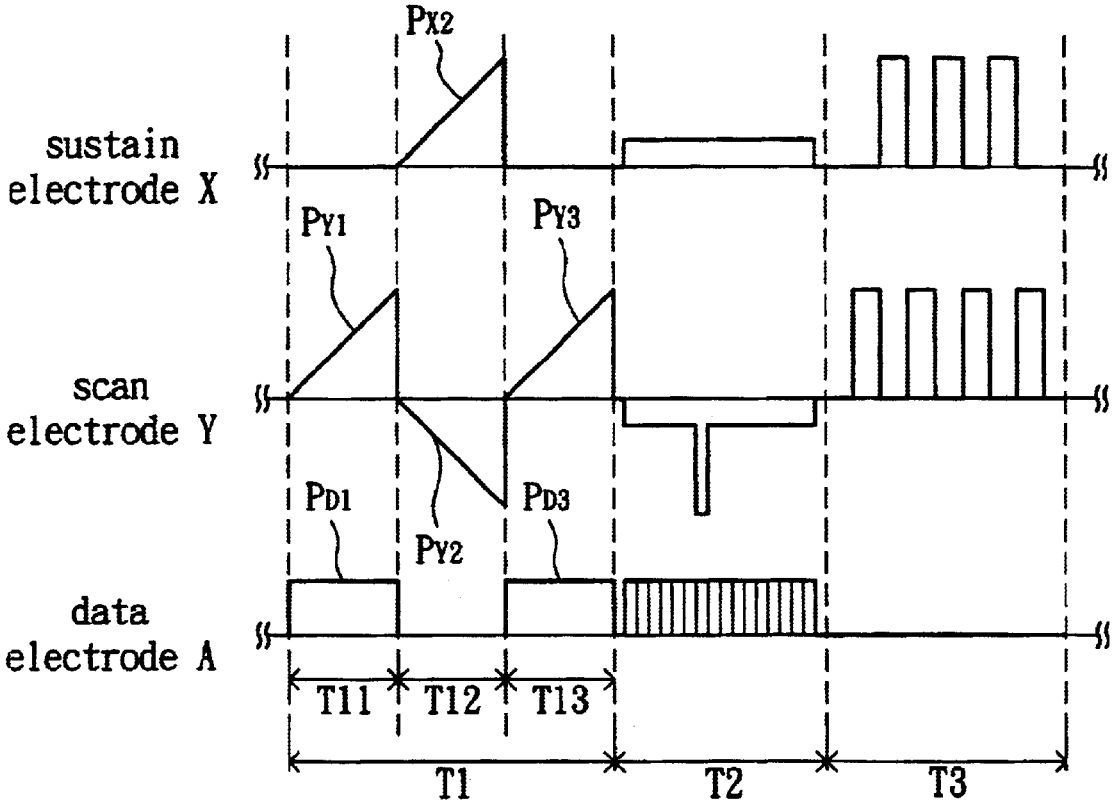
FIG. 4 illustrates the timing chart of the AC PDP according to a second embodiment of the present invention.
Figure 5:
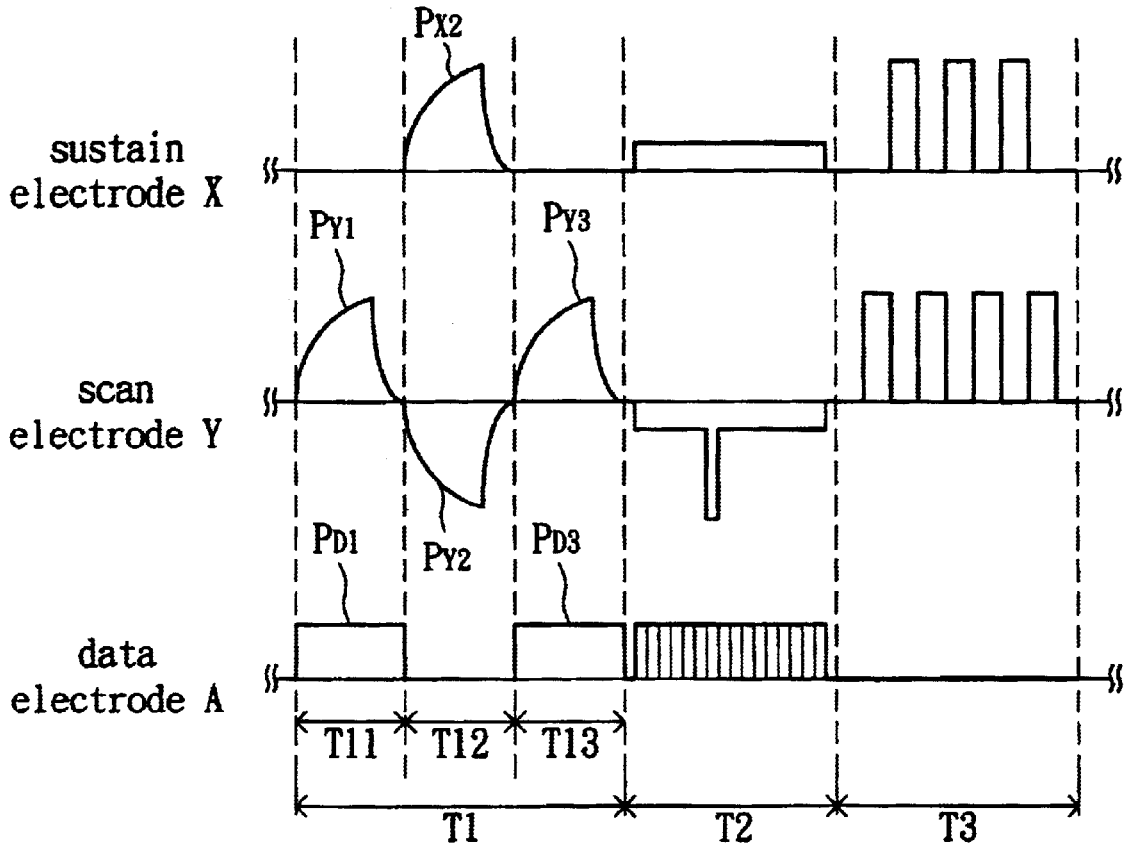
FIG. 5 illustrates the timing chart of the AC PDP according to a third embodiment of the present invention.

The priming and erase pulse waveforms, characterized in slowly increasing or decreasing with time, of the present invention is not limited to those in FIG. 3. The following embodiments shown in FIGS. 4 to 7 are also applicable. FIG. 4 illustrates the timing chart of the AC PDP according to the second embodiment of the present invention, wherein the erase pulses and the priming pulses are saw-tooth waves. FIG. 5 illustrates the timing chart of the AC PDP according to the third embodiment of the present invention, wherein the erase pulses and the priming pulses first increases and then decreases in magnitude during each reset period of T11, T12, T13.

Figure 6:
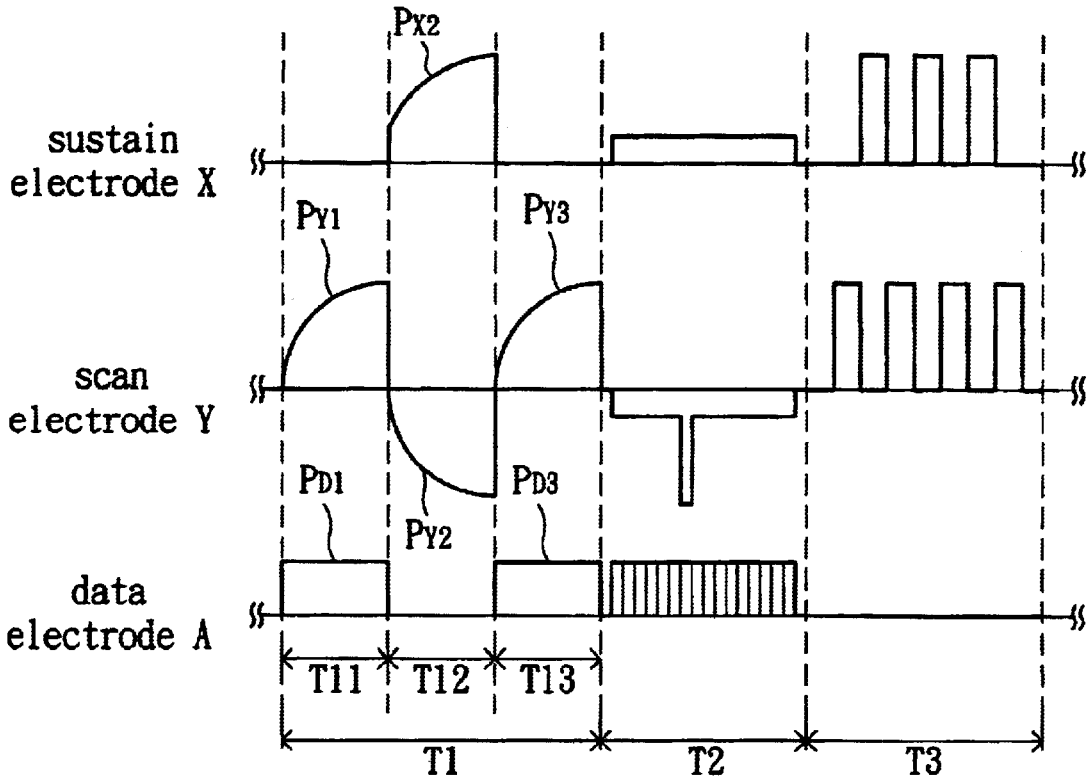
FIG. 6 illustrates the timing chart of the AC PDP according to a fourth embodiment of the present invention.

FIG. 6 illustrates the timing chart of the AC PDP according to the fourth embodiment of the present invention. Compared with that in FIG. 3, the second priming pulse $P_{X2}$ applied to the sustain electrode X during the second reset period T12 first has a DC bias and then slowly increases with time. In this way, the maximum voltage across the sustain electrode X and the scan electrode Y can be achieved within less time, and the second reset period T12 decreases.

Figure 7:
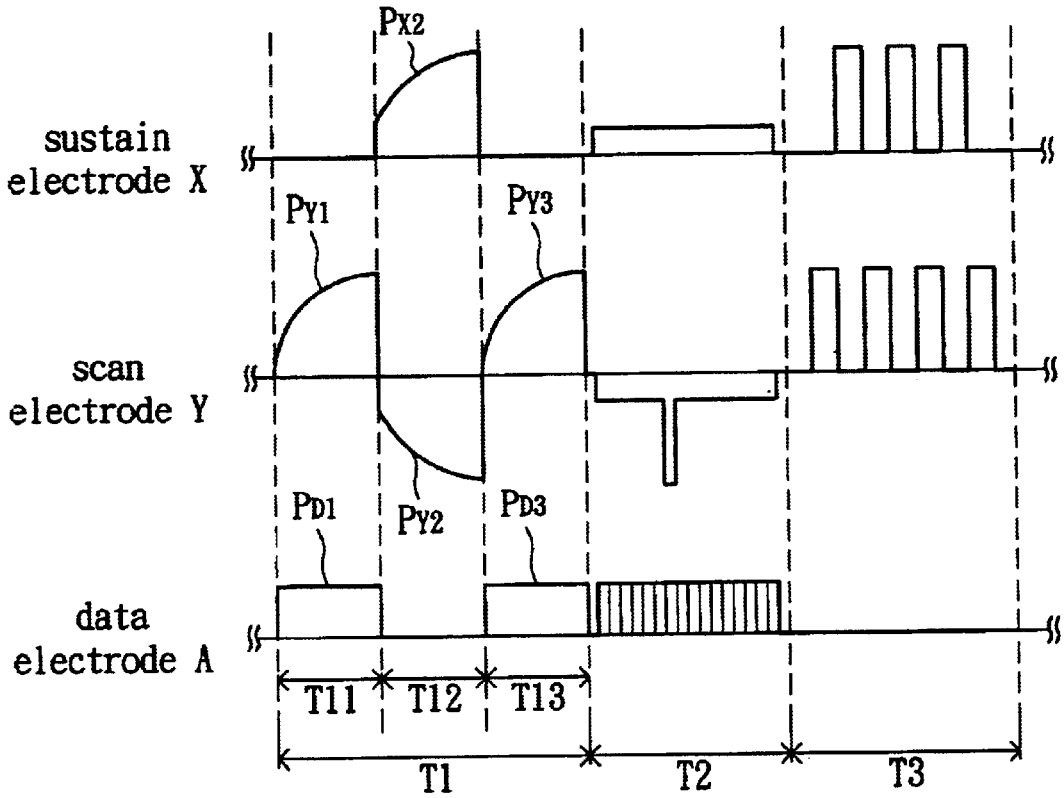
FIG. 7 illustrates the timing chart of the AC PDP according to a fifth embodiment of the present invention.

FIG. 7 illustrates the timing chart of the AC PDP according to the fifth embodiment of the present invention. Compared with that in FIG. 6, the first priming pulse $P_{Y2}$ applied to the scan electrode Y during the second reset period T12 has a DC bias, and then gradually increases in magnitude with time. In this way, the maximum voltage across the sustain electrode X and the scan electrode Y can be even more achieved within less time, and the second reset period T12 further decreases.

By applying priming and erase pulses, characterized in gradually increasing or decreasing with time, each pixel unit discharges weakly for several times with almost the same intensity in different timing during the second reset period T12. Thus, the background brightness is lowered and the brightness contrast is improved. Moreover, in the present invention, the driving circuit to apply priming and erase pulses is simpler than that of the traditional method, and the cost is lowered.

While the invention has been described by way of example and in terms of the preferred embodiment, it is to be understood that the invention is not limited to the disclosed embodiment. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A method for driving an alternating current plasma display panel (AC PDP) during a reset period, wherein said AC PDP has a plurality of pixel units, each of said pixel units has a first electrode, a second electrode and a third electrode, said first electrode and said second electrode are parallel to each other, said third electrode is perpendicular to said first electrode, and said method is used for causing the accumulation of the wall charges among said plurality of pixel units to be less different, said method comprising:

applying a first erase pulse to said first electrode of each of said pixel units so as to remove said wall charges from each of said pixel units, wherein said first erase pulse is positive in polarity and increases in magnitude with time;

applying a first priming pulse and a second priming pulse respectively to said first electrode and said second electrode so as to produce wall charges in said plurality of pixel units, wherein said first priming pulse is negative in polarity and increases in magnitude with time, and said second priming pulse is positive in polarity and increases in magnitude with time; and applying a second erase pulse to said first electrode so as to remove said wall charges, wherein said second erase pulse is positive in polarity and increases in magnitude with time.

2. The driving method according to claim 1, when said first erase pulse is applied to said first electrode of each of said pixel units, a first address pulse is applied to said third electrode, wherein said first address pulse is a square pulse in positive polarity.

3. The driving method according to claim 2, when a second erase pulse is applied to said first electrode, a second address pulse is applied to said third electrode, wherein said second address pulse is a square pulse in positive polarity.

4. The driving method according to claim 1, wherein said first erase pulse is a saw-tooth wave.

5. The driving method according to claim 1, wherein said first priming pulse is a saw-tooth wave.

6. The driving method according to claim 1, wherein said second priming pulse is a saw-tooth wave.

7. The driving method according to claim 1, wherein said second erase pulse is a saw-tooth wave.

8. The driving method according to claim 1, wherein said first priming pulse has a DC bias, and then increases with time.

9. The driving method according to claim 1, wherein said second priming pulse has a DC bias, and then slowly increases with time.

10. The driving method according to claim 1, wherein said first erase pulse first increases and then decreases in magnitude.

11. The driving method according to claim 1, wherein said first priming pulse first increases and then decreases in magnitude.

12. The driving method according to claim 1, wherein said second priming pulse first increases and then decreases in magnitude.

13. The driving method according to claim 1, wherein said second erase pulse first increases and then decreases in magnitude.

14. A circuit for driving an alternating current plasma display panel (AC PDP) during a reset period, wherein said AC PDP has a plurality of pixel units, and each of said plurality of pixel units has a first electrode, a second electrode and a third electrode, said circuit used for making the accumulation of the wall charge be less different between said plurality of pixel units, said circuit comprising:

a first erase circuit for applying a first erase pulse to said first electrode so as to remove said wall charges from said plurality of pixel units, wherein said first erase pulse is positive in polarity and increases in magnitude with time;

a first priming circuit for applying a first priming pulse to said first electrode so as to produce wall charge in said plurality of pixel units, wherein said first priming pulse is negative in polarity and increases in magnitude with time;

a second priming circuit for applying a second priming pulse to said second electrode so as to produce said wall charge in said plurality of pixel units, wherein said second priming pulse is positive in polarity and increases in magnitude with time; and a second erase circuit for applying a second erase pulse to said first electrode so as to remove said wall charges, wherein said second erase pulse is positive in magnitude and increases in magnitude with time.

15. The driving circuit according to claim 14, further comprising a first address circuit for applying a first address pulse to said third electrode, wherein said first address pulse is a square pulse in positive polarity.

16. The driving circuit according to claim 15, further comprising a second address circuit for applying a second address pulse to said third electrode, wherein said second address pulse is a square pulse in positive polarity.

17. The driving circuit according to claim 14, wherein said first electrode and said second electrode are parallel to each other, said third electrode is perpendicular to said first electrode.

* * * * *